US010030616B2

(12) United States Patent
Kim et al.

(10) Patent No.: US 10,030,616 B2
(45) Date of Patent: Jul. 24, 2018

(54) EGR COOLER FOR VEHICLE

(71) Applicant: Hyundai Motor Company, Seoul (KR)

(72) Inventors: Han Sang Kim, Ansan-si (KR); Byung Hyun Lee, Bucheon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 15/264,708

(22) Filed: Sep. 14, 2016

(65) Prior Publication Data

US 2017/0306896 A1 Oct. 26, 2017

(30) Foreign Application Priority Data

Apr. 20, 2016 (KR) ..... 10-2016-0048181

(51) Int. Cl.
*F02M 26/28* (2016.01)
*F02M 26/30* (2016.01)
*F02M 26/32* (2016.01)

(52) U.S. Cl.
CPC ..... *F02M 26/28* (2016.02); *F02M 26/30* (2016.02); *F02M 26/32* (2016.02)

(58) Field of Classification Search
CPC ..... F02M 26/28; F02M 26/32; F02M 26/30
See application file for complete search history.

(56) References Cited

U.S. PATENT DOCUMENTS 6,360,702 B1 * 3/2002 Osada ..... F28D 7/0066 123/196 AB
8,132,407 B2 * 3/2012 Li ..... F02M 26/24 123/568.11
8,839,518 B1 * 9/2014 Neal ..... B23P 15/26 29/890.03
2007/0056721 A1 * 3/2007 Usui ..... F28D 7/1684 165/183
2008/0110433 A1 * 5/2008 Lee ..... F01P 11/04 123/196 AB
2008/0164014 A1 * 7/2008 Nakamura ..... F28D 9/0025 165/165

(Continued)

FOREIGN PATENT DOCUMENTS

JP H10-002256 A 1/1998
JP 2011-127537 A 6/2011

(Continued)

OTHER PUBLICATIONS

Notice of Allowance dated Feb. 1, 2018 from the corresponding Korean Application No. 10-2016-0048181, 2 pp.

*Primary Examiner* — Joseph Dallo
(74) *Attorney, Agent, or Firm* — Brinks Gilson & Lione

(57) ABSTRACT

The present disclosure provides an EGR cooler for a vehicle. The EGR cooler includes: a gas passage having a predetermined length, the gas passage including a linear part forming a linear section and extension parts extending from opposite ends of the linear part after being bent; a heat radiation fin having a shape formed by being folded several times, the heat radiation fin being placed in the linear section of the gas passage; and a base provided with an inlet hole at a first end and an outlet hole at a second end. In particular, the inlet hole and the outlet hole each has a shape corresponding to a cross-section of the gas passage, and the extension parts are inserted into the inlet hole and the outlet hole, respectively.

10 Claims, 4 Drawing Sheets

(56) References Cited

U.S. PATENT DOCUMENTS

| | | | | |
|---|---|---|---|---|
| 2014/0020362 | A1* | 1/2014 | Warey | F01N 3/08 60/274 |
| 2014/0209073 | A1* | 7/2014 | Johnson | F02M 25/07 123/568.12 |
| 2016/0230709 | A1* | 8/2016 | Yang | F02M 26/29 |
| 2016/0265487 | A1* | 9/2016 | Beyer | F02M 35/104 |
| 2017/0138320 | A1* | 5/2017 | Kim | F02M 26/24 |
| 2017/0145948 | A1* | 5/2017 | Chu | F02M 26/14 |

FOREIGN PATENT DOCUMENTS

| | | | |
|---|---|---|---|
| JP | 2013-36452 | A | 2/2013 |
| KR | 10-2007-0025666 | A | 3/2007 |
| KR | 10-2008-0108545 | A | 12/2008 |
| KR | 10-2009-0103405 | A | 10/2009 |
| KR | 10-1543248 | B1 | 8/2015 |

* cited by examiner

EGR COOLER FOR VEHICLE

CROSS REFERENCE TO RELATED APPLICATION

The present application claims priority to and the benefit of Korean Patent Application Publication No. 10-2016-0048181, filed Apr. 20, 2016, the entire contents of which are incorporated herein by reference.

FIELD

The present disclosure relates generally to an Exhaust Gas Recirculation (EGR) cooler for cooling recirculation exhaust gas of a vehicle.

BACKGROUND

The statements in this section merely provide background information related to the present disclosure and may not constitute prior art.

Generally, an EGR cooler functions to reduce the temperature of exhaust gas in a process of recirculating vehicle exhaust gas to a suction system. Exhaust gas that is introduced into a cylinder via an inlet manifold of an engine after passing an EGR cooler is processed by reburning. Through the reburning of exhaust gas, nitrogen oxides (NOx) in exhaust gas are burnt, and the content of hazardous substances in exhaust gas finally discharged to the outside of a vehicle is reduced.

A conventional EGR cooler includes a housing in which cooling water flows, and a heat radiation fin unit placed in the housing such that the fin unit is spaced apart from a cooling water flow path. In operation of the EGR cooler, high temperature exhaust gas flows in the heat radiation fin unit, and the cooling water flows in the housing. Thus, in the operation of the EGR cooler, the temperature of the exhaust gas is reduced and the temperature of the cooling water is increased due to heat exchange between the cooling water and the exhaust gas.

In case of a buried type EGR cooler inserted into an engine cylinder block, the gas passage is required to be bent at a predetermined angle so as to correspond to the shape of a cooling water flow path of a cylinder block. However, we have discovered that if the gas passage is bent so as to correspond to the shape of the cooling water flow path, damage to a heat radiation fin provided in the gas passage may occur.

The foregoing is intended merely to aid in the understanding of the background of the present disclosure, and is not intended to mean that the present disclosure falls within the purview of the related art that is already known to those skilled in the art.

SUMMARY

The present disclosure provides an EGR cooler for a vehicle, which is configured such that although a gas passage is formed to be bent at an angle equal to or less than a predetermined angle, a heat radiation fin provided in the gas passage is not damaged and heat exchange between cooling water and recirculation exhaust gas is efficiently realized.

According to one aspect of the present disclosure, there is provided an EGR cooler for a vehicle, the EGR cooler including; a gas passage of a predetermined length, the gas passage including a linear part forming a linear section and extension parts extending from opposite ends of the linear part after being bent; a heat radiation fin having a shape formed by being folded several times, the heat radiation fin being placed in the linear section of the gas passage; and a base provided with an inlet hole at a first end thereof and an outlet hole at a second end thereof, each of the inlet hole and the outlet hole having a shape corresponding to a cross-section of the gas passage, wherein the extension parts are inserted into the inlet hole and the outlet hole, respectively.

Each of the inlet hole and the outlet hole may be configured such that a length thereof in a vertical direction of the vehicle is longer than a length thereof in a transverse direction of the vehicle, and the shape of the cross-section of the gas passage is the same as the shapes of the inlet and outlet holes.

A corner between the linear part and each of the extension parts may be formed in an arc shape so that the gas passage has an arch-shaped appearance.

Each of the extension parts may have a linear section of a predetermined length, a heat radiation fin may be provided in the linear section of each of the extension parts, and the heat radiation fins of the extension parts and the heat radiation fin of the linear part may be arranged in the same direction.

The gas passage may be provided as a plurality of gas passages, the gas passages may be arranged in a back and forth direction of the vehicle while being spaced apart from each other at predetermined intervals.

The gas passage may be provided as a plurality of gas passages, the gas passages may be arranged in a vertical direction of the vehicle while being spaced apart from each other at predetermined intervals.

The gas passage may be inserted into a cooling water flow path of an engine cylinder block such that the linear part is arranged in a direction parallel to a cooling water flowing direction in the cooling water flow path.

According to another aspect of the present disclosure, there is provided a cylinder block integrated with an EGR cooler for a vehicle includes; a cylinder block provided with a cooling water flow path; and an EGR cooler including: a gas passage of a predetermined length, the gas passage including a linear part forming a linear section and extension parts extending from opposite ends of the linear part after being bent; a heat radiation fin having a shape formed by being folded several times, the heat radiation fin being placed in the linear part of the gas passage; and a base provided with an inlet hole and an outlet hole at opposite ends thereof, each of the inlet hole and the outlet hole having a shape corresponding to a cross-section of the gas passage, with the extension parts being inserted into the inlet hole and the outlet hole, respectively, wherein the extension parts are inserted into a sidewall of the cylinder block such that the linear part is in contact with a side surface of the cooling water flow path.

The EGR cooler may be provided in an exhaust side of the cylinder block.

The heat radiation fin may be provided in a linear section of each of the extension parts of the EGR cooler.

According to the present disclosure having the above-mentioned configuration, the EGR cooler for the vehicle can increase heat exchange efficiency of cooling water with recirculation exhaust gas by adding the heat radiation fin in the gas passage, so fast warm-up can be realized. An exhaust heat recovery device during a cool operation can be easily used, and cooling water in an engine can be heated directly by recirculation exhaust gas, so warm-up time during variable split cooling can be reduced. In addition, cooling efficiency of recirculation exhaust gas is increased, so the number of gas passages can be reduced and cost reduction can be realized.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
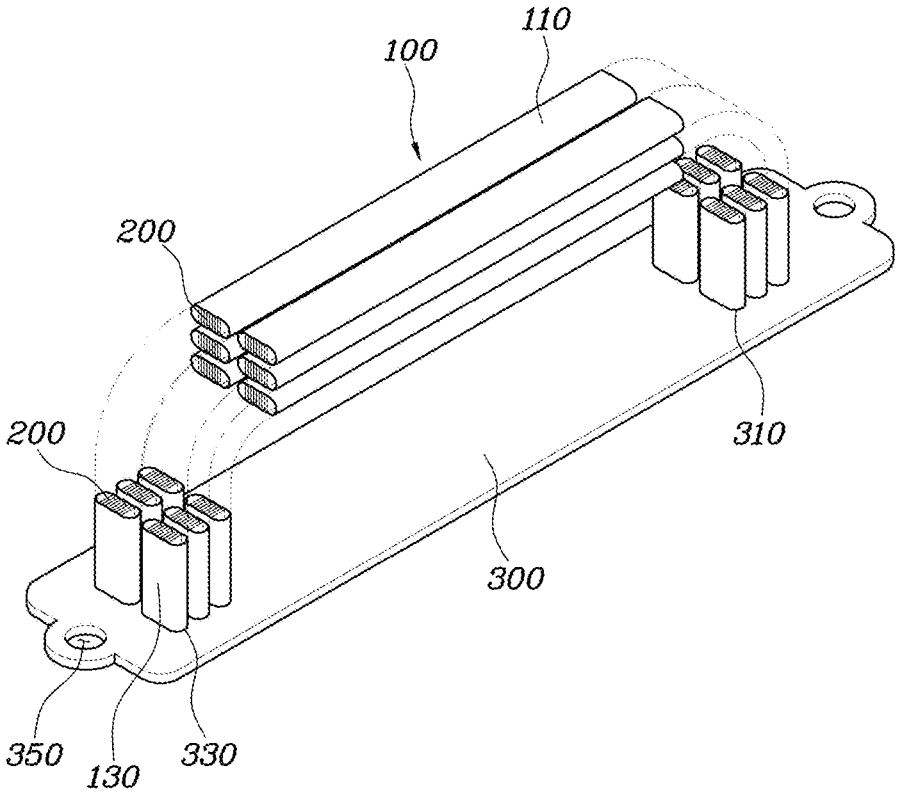
FIG. 1 is a view showing an EGR cooler according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
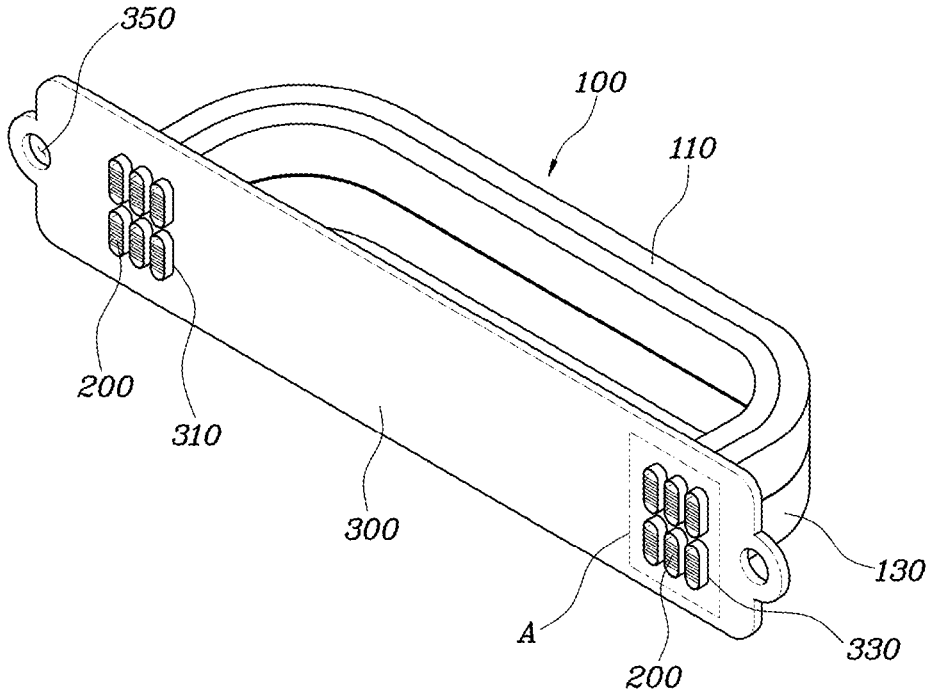
FIG. 2 is a view showing a lower surface of the EGR cooler of FIG. 1 in detail.
Figure 3:
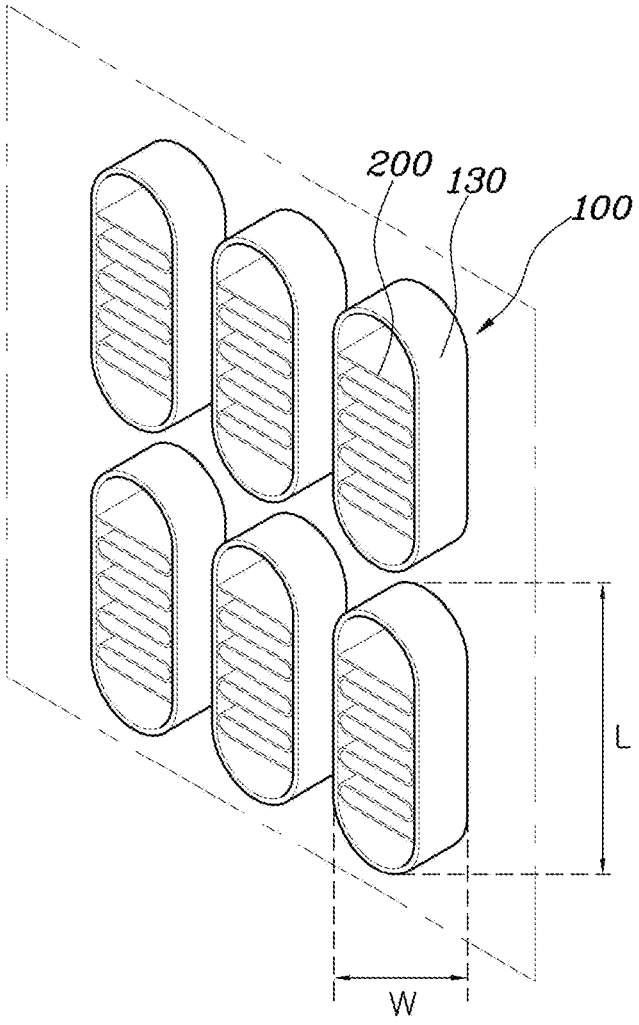
FIG. 3 is a view showing a portion A of FIG. 2 in detail.

FIG. 1 is a view showing an EGR cooler 700, FIG. 2 is a view showing a lower surface of the EGR cooler of FIG. 1 in detail, and FIG. 3 is a view showing a portion A of FIG. 2 in detail.

An EGR cooler for a vehicle includes; a gas passage 100 of a predetermined length, the gas passage including a linear part 110 forming a linear section and extension parts 130 extending from opposite ends of the linear part 110 after being bent; a heat radiation fin 200 having a shape formed by being folded several times, the heat radiation fin being placed in the linear section of the linear part 110; and a base 300 provided with an inlet hole 310 at a first end thereof and an outlet hole 330 at a second end thereof, each of the inlet hole 310 and the outlet hole 330 having a shape corresponding to the cross-section of the gas passage 100, wherein the extension parts 130 are inserted into the inlet hole 310 and the outlet hole 330, respectively.

As described above, the gas passage 100 having the predetermined length includes the linear part 110 forming the linear section, and the extension parts 130 extending from the opposite ends of the linear part 110 after being bent. That is, the gas passage 100 may be formed as an upside-down "U" shape. Because the gas passage 100 has a configuration in which exhaust gas to be recirculated is introduced through the inlet hole 310 and is discharged through the outlet hole 330 after being cooled, it is desired to form the gas passage 100 using a material having high thermal conductivity and being capable of enduring high temperature of the recirculation exhaust gas.

Referring to FIG. 3, each of the inlet hole 310 and the outlet hole 330 is configured such that the length (L) thereof in a vertical direction of a vehicle is longer than the length (W) thereof in a transverse direction of the vehicle, and the shape of the cross-section of the gas passage 100 is the same as the shapes of the inlet and outlet holes.

The heat radiation fin 200 is provided in the linear part 110. The heat radiation fin has a shape formed by being folded several times, and the lengthwise direction of the heat radiation fin 200 crosses the lengthwise direction of the gas passage 100 so that recirculation exhaust gas passes through spaces defined between the folded heat radiation fin 200 inside the gas passage 100.

The cross-section of the gas passage 100 may be formed as a circular shape. However, because the maximum density of the heat radiation fin 200 in the gas passage 100 is advantageous for cooling of the recirculation exhaust gas, to increase heat radiation efficiency, the gas passage 100 may have an oval-shaped cross-section in which the length L thereof in the vertical direction of the vehicle is longer than the length W thereof in the transverse direction of the vehicle, as shown in FIGS. 1 to 3.

Particularly, a corner between the linear part 110 and each of the extension parts 130 of the gas passage 100 is formed in an arc shape so that exhaust gas does not get trapped at the corner in order not to generate of carbon, or to disturb the flow of recirculation exhaust gas. Accordingly, the overall shape of the gas passage 100 is formed in an arch shape including the linear part 110 forming the linear section and the extension parts 130 extending from the opposite ends of the linear part 110 after being bent.

In addition, each of the extension parts 130 may form a linear section of a predetermined length, and a heat radiation fin 200 may be provided in the linear section of each of the extension parts 130 in order to increase cooling efficiency. Particularly to avoid interference with gas flow in the gas passage 100, the heat radiation fins 200 of the extension parts 130 and the heat radiation fin 200 of the linear part 110 may be arranged in the same direction. That is, the gas passage 100 has an arch-shaped appearance having linear sections of predetermined lengths in the linear part 110 and in the extension parts 130, with the heat radiation fins being placed in the linear sections so as to increase cooling efficiency by cooling the recirculation exhaust gas.

As described above, to increase cooling efficiency, the gas passage 100 may be formed of a metal material such as steel or aluminum having high thermal conductivity. In addition, the gas passage 100 is inserted in a cooling water flow path 500 of an engine cylinder block 600 so that the gas passage 100 has a shape corresponding to the shape of the cooling water flow path 500. However, when the gas passage 100 made of metal is bent to be arch-shaped after inserting the heat radiation fin 200 made of metal in the gas passage 100, the bending angle of the gas passage 100 is limited. Furthermore, when the gas passage 100 is bent at an angle exceeding the limited angle, the heat radiation fin 200 placed in the bent portion may be damaged. Accordingly, in the present disclosure, the heat radiation fin 200 is inserted only in the linear section while omitting the heat radiation fin 200 from the bent portion of the gas passage 100, thereby realizing an increase in cooling efficiency while inhibiting or preventing damage to the heat radiation fin 200.

In other words, in the present disclosure, the heat radiation fin 200 is inserted only in the linear section while eliminating the heat radiation fin from bent portions of the gas passage 100 at which the linear part 110 meets the extension parts 130. Thus, the gas passage 100 of the present disclosure can be efficiently bent at an angle almost approaching 90° such that the gas passage is agreeable with the cooling water flow path 500 of cylinder block 600, thereby taking up less space and increasing cooling efficiency.

The gas passage 100 may be provided as a plurality of gas passages that are arranged in a back and forth direction of the vehicle while being spaced apart from each other at predetermined intervals. Alternatively, the gas passage 100 may be provided as a plurality of gas passages that are arranged in a vertical direction of the vehicle while being spaced apart from each other at predetermined intervals to form a multilayered configuration. Accordingly, the EGR cooler can quickly cool a large amount of recirculation exhaust gas within a short period of time, thereby increasing cooling efficiency.

The gas passage 100 is combined with the base 300 having a panel or plate shape. The base 300 is provided with the inlet hole 310 and the outlet hole 330 at opposite ends thereof. The lower ends of the extension parts 130 of the gas passage 100 are combined with the inlet hole 310 and the outlet hole 330, respectively, by penetrating the holes 310 and 330. FIG. 2 shows the combination of the gas passage 100 with the base 300 in detail.

In addition, each end of the base 300 is provided with a locking hole 350 so that the base 300 can be locked to the cylinder block 600 using a locking member (not shown). Here, the gas passage 100 may be partially inserted into the cylinder block 600 such that the gas passage 100 is integrated with the cylinder block 600. Particularly, the gas passage 100 may be inserted into the cooling water flow path 500 of the cylinder block 600 by passing it. Here, the linear part 110 of the gas passage 100 is arranged in a direction parallel to a cooling water flowing direction in the cooling water flow path 500, thereby increasing heat exchange efficiency between the cooling water and the recirculation exhaust gas.

Figure 4:
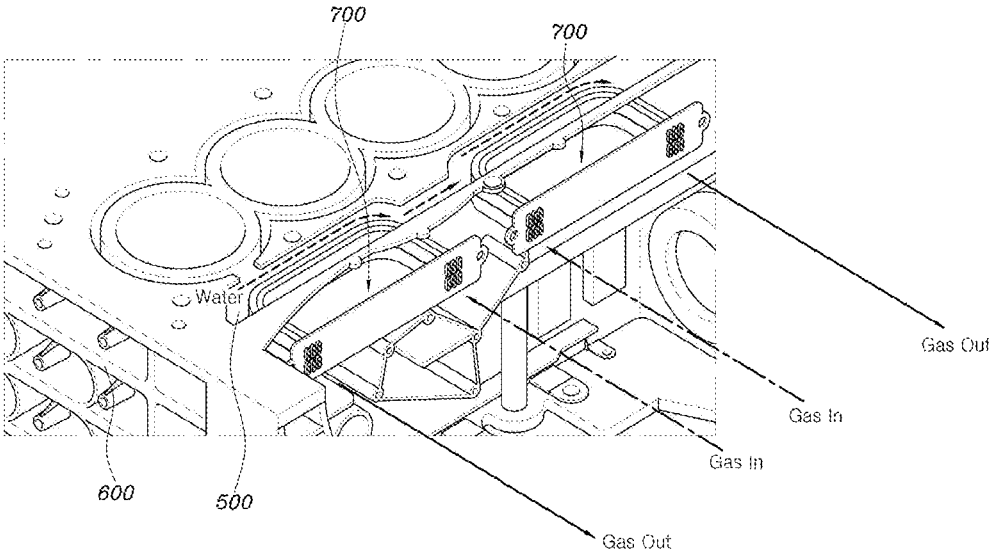
FIG. 4 is a view showing a cylinder block integrated with an EGR cooler for a vehicle according to the present disclosure.

FIG. 4 is a view showing a cylinder block 600 integrated with an EGR cooler for a vehicle. The combination relationship between the EGR cooler with the cylinder block 600 will be described in detail with reference to FIG. 4.

The EGR cooler 700 for a vehicle may be inserted into an engine cylinder block 600 so as to be integrated with the cylinder block 600. Accordingly, the cylinder block integrated with the EGR cooler 700, in which the EGR cooler 700 is inserted into the cylinder block 600 and is integrated with the cylinder block 600, includes: a cylinder block 600 provided with a cooling water flow path 500; and an EGR cooler including: a gas passage 100 of a predetermined length, the gas passage 100 having a linear part 110 forming a linear section and extension parts 130 extending from opposite ends of the linear part 110 after being bent; a heat radiation fin 200 having a shape formed by being folded several times, the heat radiation fin being placed in the linear part 110 of the gas passage; and a base 300 provided with an inlet hole 310 and an outlet hole 330 at opposite ends thereof, each of the inlet hole 310 and the outlet hole 330 having a shape corresponding to the cross-section of the gas passage 100, with the extension parts 130 being inserted into the inlet hole 310 and the outlet hole 330, respectively. In particular, the extension parts 130 are inserted into a sidewall of the cylinder block 600 such that the linear part 110 is in contact with a side surface of the cooling water flow path 500. In addition, a heat radiation fin 200 may be provided in a linear section of each of the extension parts 130 of the gas passage 100, thereby increasing the cooling efficiency.

The EGR cooler 700 may be provided as a plurality of EGR coolers arranged in an exhaust side of the cylinder block 600 while being spaced apart from each other at predetermined intervals. Particularly, the EGR coolers 700 may be provided in the cooling water flow path 500 at the exhaust side of the cylinder block 600 such that the cooling water inside the cooling water flow path 500 passes by the linear part 110 of the gas passage 100. Thus, the EGR cooler can increase the contact area with recirculation exhaust gas inside the gas passage 100 thereby further increasing heat exchange efficiency between the cooling water and the recirculation exhaust gas.

In addition, the EGR coolers 700 may be symmetrically arranged to form a symmetric arrangement, as shown in FIG. 4. Accordingly, the inlet hole 310 may not be formed on a left side of the base 300 of the EGR cooler 700, but a hole formed inside the cylinder block 600 may serve as an inlet hole 310, and another hole formed outside the cylinder block 600 may serve as an outlet hole 330 according to design or layout conditions, as shown in FIG. 4.

Accordingly, the EGR cooler for a vehicle can increase heat exchange efficiency of cooling water with recirculation exhaust gas by adding the heat radiation fin in the gas passage, so fast warm-up can be realized. In addition, an exhaust heat recovery device during a cool operation can be easily used, and cooling water in an engine can be heated directly by recirculation exhaust gas, so warm-up time during variable split cooling can be reduced. Additionally, cooling efficiency of recirculation exhaust gas is increased, so the number of gas passages can be reduced, and thereby cost is reduced.

Although one form of the present disclosure has been described for illustrative purposes, those skilled in the art will appreciate that various modifications, additions and substitutions are possible, without departing from the scope and spirit of the present disclosure.

What is claimed is:

1. An Exhaust Gas Recirculation (EGR) cooler for a vehicle, the EGR cooler comprising;

a gas passage having a predetermined length, the gas passage including:

a linear part forming a linear section in which a heat radiation fin is placed, extension parts extending from opposite ends of the linear part, and one or more bent portions connecting the linear part to the extension parts, the bent portions being void of the heat radiation fin; and a base provided with an inlet hole at a first end thereof and an outlet hole at a second end thereof, the inlet hole and the outlet hole each having a shape corresponding to a cross-section of the gas passage, wherein the extension parts are inserted into the inlet hole and the outlet hole, respectively, and the heat radiation fin has a folded shape and extends along the linear section.

2. The EGR cooler of claim 1, wherein each of the inlet hole and the outlet hole is configured such that a length thereof in a vertical direction of the vehicle is longer than a length thereof in a transverse direction of the vehicle, and a shape of the cross-section of the gas passage is same as a cross-section shape of the inlet and outlet holes.

3. The EGR cooler of claim 1, wherein the bent portions between the linear part and each of the extension parts is formed in an arc shape so that the gas passage has an arch-shaped appearance.

4. The EGR cooler of claim 1, wherein each of the extension parts has a linear section of a predetermined length, a heat radiation fin is provided in the linear section of each of the extension parts, and the heat radiation fins of the extension parts and the heat radiation fin of the linear part are arranged in a same direction.

5. The EGR cooler of claim 1, wherein the gas passage is provided as a plurality of gas passages, the gas passages being arranged in a back and forth direction of the vehicle while being spaced apart from each other at predetermined intervals.

6. The EGR cooler of claim 1, wherein the gas passage is provided as a plurality of gas passages, the gas passages being arranged in a vertical direction of the vehicle while being spaced apart from each other at predetermined intervals.

7. The EGR cooler of claim 1, wherein the gas passage is inserted into a cooling water flow path of an engine cylinder block such that the linear part is arranged in a direction parallel to a cooling water flowing direction in the cooling water flow path.

8. A cylinder block integrated with an Exhaust Gas Recirculation (EGR) cooler for a vehicle, the cylinder block comprising:

a cylinder block provided with a cooling water flow path; and an EGR cooler including:

a gas passage having a predetermined length, the gas passage including;

a linear part forming a linear section in which a heat radiation fin is placed, extension parts extending from opposite ends of the linear part, and one or more bent portions connecting the liner part to the extension parts; and a base provided with an inlet hole and an outlet hole at opposite ends thereof, the inlet hole and the outlet hole each having a shape corresponding to a cross-section of the gas passage, wherein the heat radiation fin has a shape formed by being folded several times, extends along the linear section, and ends at a junction area where the linear part meets the bent portions, and wherein the extension parts are inserted into the inlet hole and the outlet hole, respectively, and the extension parts are inserted into a sidewall of the cylinder block such that the linear part is in contact with a side surface of the cooling water flow path.

9. The cylinder block of claim 8, wherein the EGR cooler is provided in an exhaust side of the cylinder block.

10. The cylinder block of claim 8, wherein a heat radiation fin is provided in a linear section of each of the extension parts of the EGR cooler.

* * * * *